United States Patent [19]

Kojima et al.

[11] Patent Number: 4,654,649

[45] Date of Patent: Mar. 31, 1987

[54] DISPLAY DEVICE

[75] Inventors: Takuya Kojima, Kanagawa; Shoichi Miyashiro, Yokohama; Yoshimitsu Aramaki, Kawasaki, all of Japan

[73] Assignee: Tokyo Shibaura Denki Kabushiki Kaisha, Kawasaki, Japan

[21] Appl. No.: 514,251

[22] Filed: Jul. 15, 1983

[30] Foreign Application Priority Data

Jul. 20, 1982 [JP] Japan ..... 57-124996

[51] Int. Cl.[4] ..... G09G 3/00

[52] U.S. Cl. ..... 340/719; 340/767; 340/781; 340/703; 340/794; 315/169.4

[58] Field of Search ..... 340/760, 766, 772, 718, 340/719, 797, 781, 794, 767, 703; 315/13.11, 169.4; 250/492.2, 492.3

[56] References Cited

U.S. PATENT DOCUMENTS

| | | | |
|---|---|---|---|
| 2,969,481 | 1/1961 | Sack, Jr. | 340/719 |
| 3,086,143 | 4/1963 | Wolfe | 340/719 |
| 3,575,634 | 4/1971 | Yokohama | 340/794 |
| 3,624,273 | 11/1971 | Gale | 340/781 |
| 3,675,075 | 4/1972 | Kohashi | 340/781 |
| 3,895,234 | 7/1975 | O'Keefe et al. | 250/492.2 |
| 3,921,022 | 11/1975 | Levine . | |
| 4,406,997 | 9/1983 | Depp et al. | 340/781 |

FOREIGN PATENT DOCUMENTS 55-148353 11/1980 Japan .

*Primary Examiner*—Marshall M. Curtis

*Attorney, Agent, or Firm*—Cushman, Darby & Cushman

[57] ABSTRACT

In a display device, a picture element capacitor is connected to a light emitting element provided in each picture element. This picture element capacitor is connected to a signal source through a switching element. The picture element is charged, by the signal source, with a signal charge corresponding to an input signal, through the closure of the switching element during some period of time. The signal charge charged into the picture element capacitor is supplied to the light emitting element, whereby the element emits lights.

13 Claims, 31 Drawing Figures

DISPLAY DEVICE

BACKGROUND OF THE INVENTION

This invention relates to a display device which is suitably applied to a planar television, terminal displays of various systems, and the like.

There have in recent years been developed various types of planar displays, in regard to which, however, it is pointed out that various problems exist. For example, a planar display which is formed of a flat cathode ray tube fails to provide a high and uniform picture luminance, a lessened flicker, etc. and also poses the problems such as the difficulty of manufacture. There are also liquid crystal display, plasma display, etc. However, these displays also have similar problems such as the picture being dark, the luminance being non-uniform, etc.

SUMMARY OF THE INVENTION

The object of the present invention is to provide a novel planar display device whose picture luminance is uniform and high and whose flicker is lessened.

According to the present invention, there is provided a display device which comprises a means for storing electric charge, a means for charging signal charge corresponding to an input signal into said storing means for a specified first period of time, and a means for emitting light due to the discharge of the signal charge charged into said storing means for a second period of time succeeding to this specified period of time.

DETAILED DESCRIPTION OF THE PREFERRED EMBODIMENTS

Figure 1:
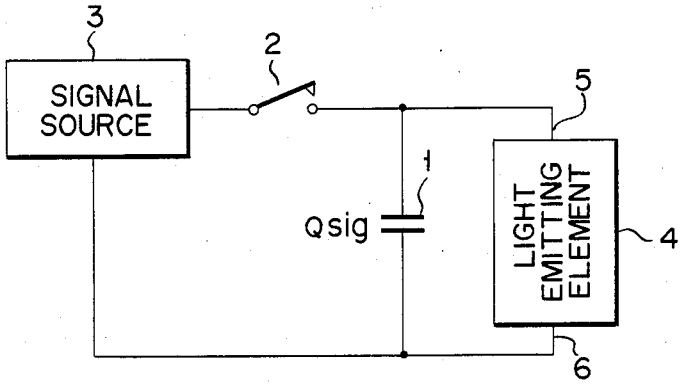
FIG. 1 is a circuit diagram for explaining the fundamental principle of the present invention.

In FIG. 1, there is shown a circuit diagram for driving a light emitting element as a picture element, which is used to explain the fundamental principle of the present invention. In the circuit shown in FIG. 1, a picture element capacitor 1 is provided with respect to each unitary picture element. To this picture element capacitor 1, a signal source 3 is connected through a switch 2 for charging the picture element capacitor 1 with a signal charge Qsig corresponding to an input signal or video signal. Further, the light emitting element 4 is also connected to the picture element capacitor 1, said light emitting element being capable of emitting lights when the signal charge Qsig charged into the picture element capacitor 1 is discharged. This light emitting element 4 permits the passage of the signal charge therethrough and the light emission thereof is maintained until the voltage of one terminal 5 of the element 4 reaches a reference potential.

Figure 2:
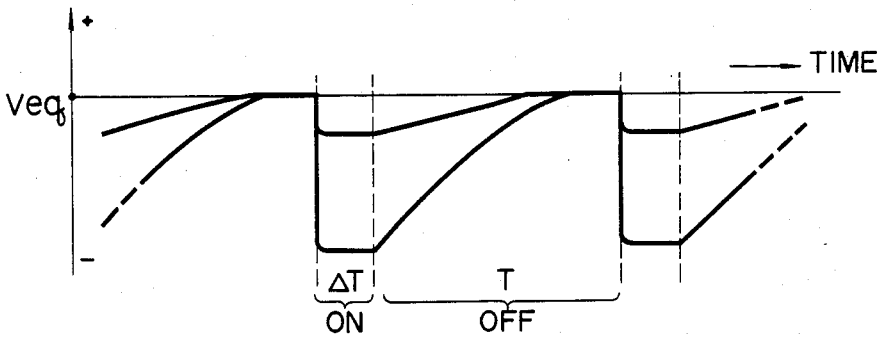
FIG. 2 is a graph showing the variation in cathode potential.

In the circuit shown in FIG. 1, when, after the one terminal 5 of the light emitting element 4 reaches a equilibrium potential or reference potential, the switch 2 is closed within a period $\Delta T$ of time for signal write-in operation, the signal charge Qsig corresponding to a predetermined input signal is charged into the picture element 1 from the signal source 3. At this time, as shown in FIG. 2, the potential of the one terminal 5 of the light emitting element 4 decreases down to a level lower than the equilibrium potential Veq. In this case, the larger the input signal corresponding to a bright image, the more the potential of the terminal 5 decreases. After the write-in is completed, that is, after the signal charge Qsig from the signal source 3 corresponding to the input signal is accumulated into the picture element capacitor 1, the switch 2 is opened.

When, as above, the signal charge Qsig is charged into the picture element capacitor 1, the potential of the terminal 5 of the light emitting element 4 becomes negative, or a level lower than the equilibrium potential, and a discharge occurs from the terminal 5 to the other terminal 6, whereby charge passes through the light emitting element 4. As a consequence, the potential of said one terminal 5 of the light emitting element 4 again reaches the equilibrium potential in a period of time T, as mentioned before. In the circuit shown in FIG. 1, therefore, a total amount of charge discharged from the terminal 5 of the light emitting element 4 is equal, in principle, to the amount of signal charge charged into the picture element capacitor 1, and as a result the light emitting element 4 emits light correspondingly to the amount of charge passing through itself, namely emits light in correspondence to the input signal.

In a planar display device having, as the picture element, the circuit shown in FIG. 1, it is experimentally confirmed that the picture luminance can be uniform and that display can be made with high luminance. Furthermore, it is possible to prevent the difference in precision between the picture elements occurring in assembling the display device, from affecting the uniformity of the picture luminance.

The above-mentioned light emitting element is here defined to mean the element which is capable of emitting light and which is optionally varied due to the passage of current therethrough.

Figure 3A:
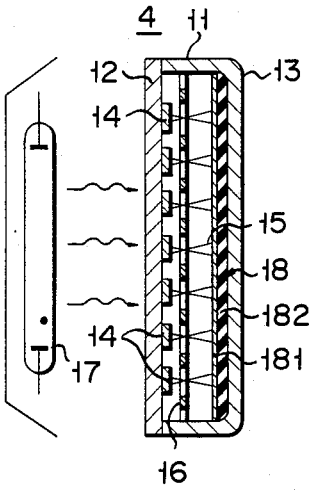
FIGS. 3A and 3B are a sectional view and a sectional view, partly broken away, schematically showing the planar display device according to an embodiment of the invention, respectively.
Figure 3B:
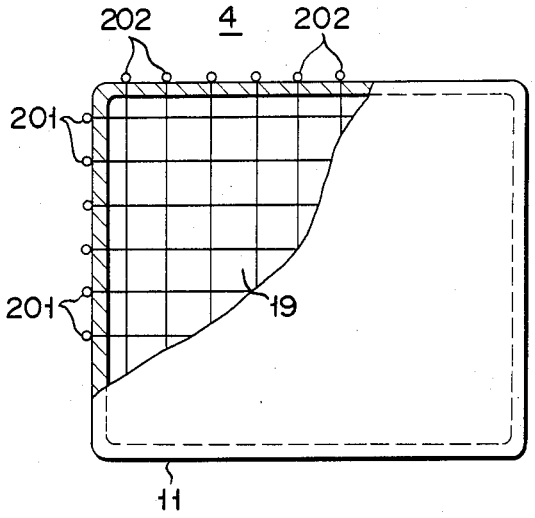

Hereinafter, a planar display device according to an embodiment of the invention, based on the application of the circuit shown in FIG. 1, will now be explained with reference to FIGS. 3A to 3B. In the planar display device shown in FIGS. 3A and 3B, a photoelectric cathode 14 which is excited by ultraviolet rays is used as the cathode, while a fluorescent material screen is used as an output electrode 18. As shown in FIG. 3A, a body of the display device is received within a vacuum envelope 11 made airtight and evacuated. A rear plate 12 is made of a material such as quarts, which permits the transmission therethrough of ultraviolet rays, and a front panel or plate 13 is made of, for example, glass permitting the passage therethrough of visible light. On the inner surface of the rear plate 12, cathodes 14 are arranged in the form of a matrix as constituting a large number of picture elements 19. These cathodes 14 are connected to lead terminals 201 for column picture elements and lead terminals 202 for row picture elements to be drive the device from outside. An auxiliary electrode or control grid 16 is located in front of the cathode 14. This auxiliary electrode 16, generally, is arranged, over the entire screen surface and electrical mutually connected. The output electrode 18 is provided on the inner surface of the front plate 13 in such a manner as to oppose the auxiliary electrode 16 and the cathode 14. This output electrode 18 is comprised of a fluorescent material layer 182 coated onto the inner surface of the front plate 13, and a metal backed layer 181 coated onto this layer 182. A positive voltage is applied to the metal backed layer 181 for accelerating the electron current 15 of electrons emitted from the cathode 14. A light source 17 of ultraviolet rays is located rearwards of the rear plate 12 of the vacuum envelope 11 and uniformly irradiates the rear plate 12, thereby exciting the cathode 14.

Next, the structure of the cathode 14 formed on the rear plate 12 will now be explained with reference to FIGS. 4A to 4F.

Figure 4A:
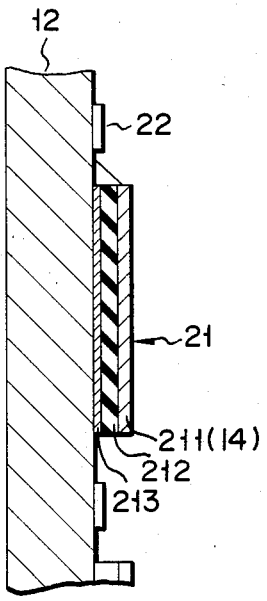
FIGS. 4A and 4B are a sectional view, partly broken away, and a plan view, showing the structure of a photoelectric cathode section of the display device shown in FIGS. 3A and 3B, respectively.

As shown in FIG. 4A, the photoelectric cathode 14 is composed of cesium iodide (CsI) and is formed on the picture element capacitor 21, which is constituted by a first electrode 213 formed on the rear plate 12, dielectric material layer 212, and a second electrode 211 formed on the first electrode 213 through the dielectric material layer 212. In this case, the second electrode 211 is connected to a drain electrode 221 of an FET 22 as a switching element 2 as later described, and serves concurrently as one electrode of the picture element capacitor 21 and as the photoelectric electrode 14. The first electrode 213 of the picture element capacitor 21 is prepared by depositing a metal film of chromium of, for example, 100 Å onto the inner surface of the rear plate 12. Preferably, this metal film transmits the ultraviolet rays as much as possible therethrough and is as highly conductive as possible. The rear electrodes 213 of the whole picture elements are connected to each other and are connected to a terminal of the device. The dielectric material layer 212 is made of, for example, silicon dioxide. If this layer 212 has a thickness of about 5000 Å, its capacitance is about 7000 PF/cm$^2$. Accordingly, where the picture element has a size of 200×200 μm, about 2500 picture elements exist per unit area of 1 cm$^2$. Accordingly, the capacitance is about 3 PF per picture element. This capacitance should be determined in accordance with the number of picture elements, the size of picture screen, and other intended specifications of display. Of course, other material may be used as the dielectric material. Preferably, the dielectric material layer has a high transmission therethrough of ultraviolet rays. The second electrode 211 is formed on the dielectric layer. This electrode 211 may be a thin film of chromium of, for example, 100 Å, preferably, is highly capable of transmitting the ultraviolet rays therethrough and is also highly conductive as in the case of the first electrode 213. This second electrode 211 is connected to the terminal of the device through the FET provided to each picture element.

Figure 4B:
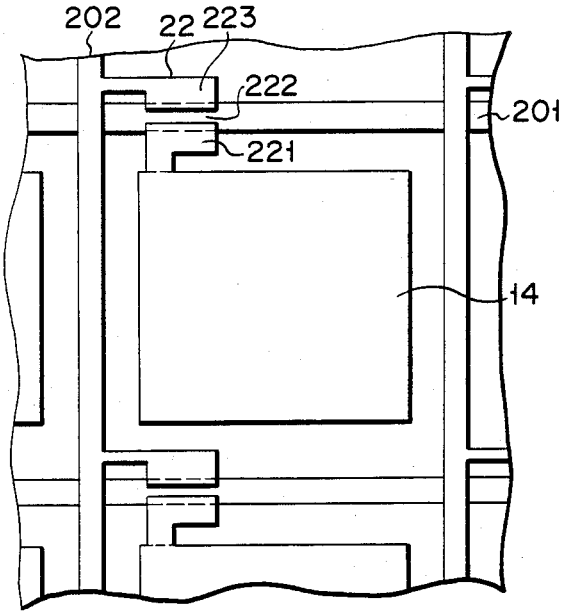

As shown in FIG. 4B, a source electrode 223 of the FET 22 is connected to its corresponding lead 202 for row picture element, disposed adjacent thereto. A gate electrode 222 of the FET 22 is connected to its corresponding lead 201 for column picture element, disposed adjacent thereto. Further, a drain electrode 221 of the FET 22 is connected to the second electrode 211.

Figure 4C:
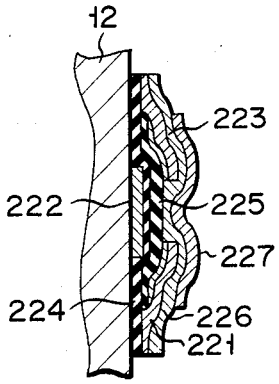
FIG. 4C is an enlarged sectional view of the switching element shown in FIGS. 4A and 4B.

As shown in FIG. 4C in detail, the FET 22 can be formed of, for example, amorphous silicon on the rear plate 12. The gate electrode 222 is formed of, for example, molybdenum, aluminum or chromium on the rear plate 12. On this gate electrode 222, an oxide film 224 of silicon is formed, and on this oxide film an amorphous silicon layer 225 is formed. On this amorphous silicon layer 225, the drain electrode 221 and source electrode 223 are formed of, for example, aluminum. The manufacture of these layer or electrodes is possible with a known technique, but, preferably, the gate electrode 222 has the lowest possible capability of transmitting the ultraviolet rays therethrough. An insulator layer 226 and a metal layer 227 are provided on the upper surface of the FET 22 for the purpose of protecting the interior of the FET 22 and shielding the same from external lights, thereby preventing the FET 22 from making an erroneous operation.

The photoelectric cathode 14 is formed of, for example, cesium iodide (CsI). The cesium iodide is provided on the second electrode 211, by vacuum deposition. The thickness is to an extent of, for example, 100 Å to 200 Å in approximation. The cesium iodide is capable of releasing photoelectrons when it is irradiated with ultraviolet rays through the rear plate 12. Since the cesium iodide has a high resistance, it is possible in some cases that, after the said picture element capacitor 21, FET 22 and the row and column lead wires 201 and 202, etc. are formed on the rear plate 12, the cesium iodide may be deposited on the overall surface thereof, without separating the cesium iodide layer for each picture element. Further, it is possible to use copper iodide (CuI), palladium (Pd), gold (Au) and the like in place of cesium iodide (CsI). Since each of the photoelectric cathodes 14 is prepared from a material having a low resistance, it is necessary to arrange the photoelectric cathodes so as to be electrically isolated each other. Further, the photoelectric surface has a different sensitivity to the wavelength according to the material constituting this surface. Accordingly, the ultraviolet rays source, the material of the rear plate 12 and other members is so preferably selected as to be balanced in regard to the transmission, absorption, and other properties. For instance, when cesium iodide (CsI) is selected as the material of the photoelectric cathode, it is preferable to use fused quartz as the material of the rear plate 12, and a mercury discharge lamp capable of giving forth the ultraviolet rays of 1850 Å as the ultraviolet rays source. Where copper iodide (CuI) is selected as the material of the photoelectric cathode, it is preferable to use a mercury discharge lamp of the wavelength of 2540 Å as the ultraviolet rays source and quartz glass or an ultraviolet ray transmission glass. It should be noted here that it is possible, in principle, to use a photoelectric surface material having sensitivity to visible lights and in this case to use a visible light in place of the ultraviolet rays. Almost all of the photoelectric materials having a sensitivity practically usable in the visible light region are cesium compounds and they are fabricated into the photoelectric layer by chemical reaction under vacuum. However, if the vacuum condition is even once deteriorated or more exposed to air (vapor, oxygen, or the like) in a manufacturing process, the cesium compounds layer are broken down permanently. The use of the Cs compounds, therefore, has a drawback that it is necessary to complete the whole assembling process without breaking the vacuumization. In contrast, there exists among the photoelectric surface materials having a sensitivity to the ultraviolet region a material which, if certain consideration is given to handling it, permits the resultant photoelectric surface to be prevented from being permanently broken down even when it is exposed to an atmosphere.

The above-mentioned examples fall upon such material. In this case, it is possible to obtain a final product by depositing the photoelectric layer onto a base plate and assembling the resultant member with other member in an atmosphere and again evacuating at a final stage of fabrication.

Figure 4D:
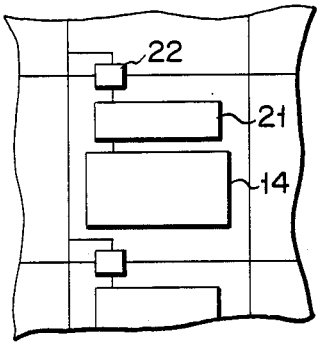
FIGS. 4D to 4F are plan views schematically showing modifications of the cathode section.
Figure 4E:
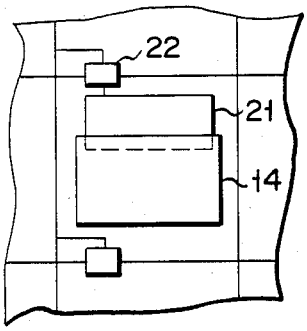
Figure 4F:
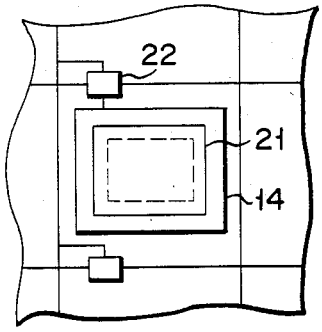

The arrangement of the photoelectric cathode 14 and the picture element capacitor 21 may be such that both are allowed to overlap upon each other as shown in FIG. 4A, and may also be such that, as shown FIGS. 4D to 4F, both are allowed partially to overlap upon each other, or such that the picture element capacitor 21 is totally covered by the photoelectric cathode 14 as shown in FIG. 4F.

With respect to the output electrode 18, as shown in FIG. 3, the fluorescent material layer 182 is formed on the inner surface of the front plate 13, and on this layer there is overlapped a metal backed layer 181 made of aluminum and having a thickness of, for example, about 800 Å. The fluorescent material layer 182 and the metal backed layer 181 may be manufactured by a method similar to a prior art one for manufacturing a cathode ray tube. The metal backed layer not only have the function similar to that performed in the prior art cathode ray tube but also serves, in this case, to absorb or reflect the stray ultraviolet rays from the rear plate thereby obstructing the fluorescent material from its unnecessary light emission, thereby preventing the decrease in contrast.

Next, the auxiliary electrode 16 is composed of a thin sheet of metal and is formed by forming the metal thin sheet with a round or square bore of substantially the same dimension as that of the photoelectric cathode 14 at a position corresponding to each picture element of the matrix. This auxiliary electrode 16 is disposed at a space interval of, for example, about 0.5 mm from the cathode 14 and is connected to a lead wire extending outside the device.

The above-mentioned parts thus prepared, after they are assembled, have sealed thereto the rear plate 12 and the front plate 13, and the resultant envelope has its interior evacuated, with the result that the planar display device is completed.

Figure 5:
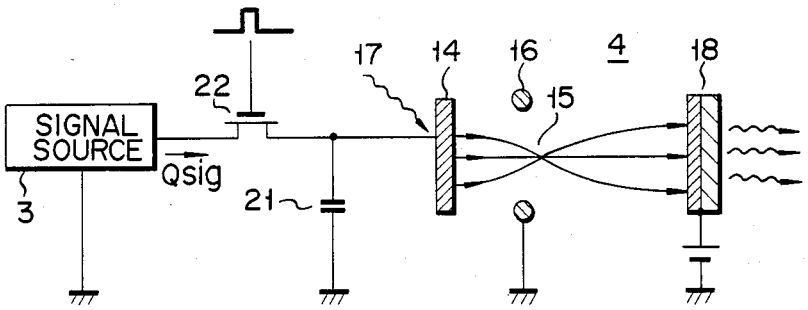
FIG. 5 shows an equivalent circuit of the display device with respect to each picture element shown in FIGS. 3A and 3B.

The operation of the planar display device shown in FIGS. 3A and 3B will now be described. For brevity of description, the display operation of the unitary picture element will first be described with reference to FIGS. 5 and 6. The auxiliary electrode 16 shown in FIG. 5 is maintained at a voltage of 0V, and the photoelectric cathode 14 is at all times irradiated with ultraviolet rays 17. When the FET 22 is turned off during the period of time in which the photoelectric cathode 14 is maintained at an appreciably low voltage, namely a voltage lower than the equilibrium potential, photoelectrons are released from the surface of the cathode 14, with the result that this cathode 14 is positive-charged by degrees at the same time. As the potential of the cathode 14 increases, an electric field prevailing just in front of the cathode 14 acts, due to the existence of the auxiliary electrode 16 located in front and maintained at a voltage of 0 V, to suppress the emission of electrons from the cathode 14, with the result that the potential of the cathode 14 is brought into a state of equilibrium. This phenomenon resembles a one that what is called "triode" is brought into a cut-off state. The value Veq of the equilibrium potential is mainly determined depending upon the geometric size and disposition of the photoelectric cathode 14 and the auxiliary electrode 16, or the relative position, potential, etc. of the output electrode 18, etc., and is further affected by the initial velocity distribution of the photoelectrons as well. For instance, this equilibrium potential can be set to a positive value of several to scores of volts relative to the auxiliary electrode 16. The relation of the cathode potential with the emitted electrons established where the auxiliary electrode 16 is maintained at a voltage of 0 V (volt) is shown as in FIG. 6.

The display operation of the unitary picture element as one of the picture elements which are arranged in the form of a two-dimensional matrix has above been described with reference to FIG. 5. Actually, however, the picture elements arranged in the form of the two-dimensional matrix are consecutively energized to emit light with a television scanning.

After the potential of the cathode 14 incorporated in the unitary picture element reaches the equilibrium potential Veq, a write-in period of time $\Delta T$ follows immediately. At the time of the write-in operation, a pulse is supplied from a signal source to the gate of the FET 22 incorporated in the unitary picture element, whereby the FET 22 is rendered conductive. As a result, the negative signal charge Qsig corresponding to the level of an image signal is supplied from the signal source to the picture element capacitor 21. As a result, the potential of the cathode 14 is lowered from the equilibrium potential to a value which is negative. When it is now assumed that the write-in period of time $\Delta T$ is sufficiently small with respect to a one-frame period of time T, then, the cathode potential is lowered from the equilibrium potential Veq by the extent corresponding to the level of the image signal when the period $\Delta T$ has lapsed whereby the FET 22 is rendered nonconductive.

When the photoelectrons are released, due to the excitation of the ultraviolet rays, from the surface of the cathode 14, the potential of the cathode 14 increases, as mentioned above, up to the equilibrium potential Veq and ceases to increase there. In other words, in principle, the electrons current is allowed to flow out of the cathode correspondingly to the signal charge Qsig inputted into the picture element.

Figure 6:
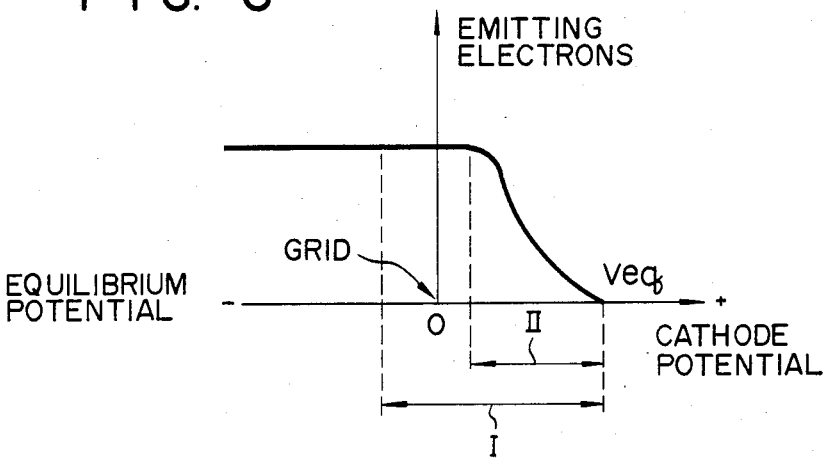
FIG. 6 is a graph showing the relation of the cathode potential of the cathode shown in FIG. 5 with the electrons emitted from this cathode.

During the write-in operation, the cathode potential has its level varied in the following two ways: one being that, as shown in I of FIG. 6, the level varies within the range of from the equilibrium potential Veq to a potential falling within the negative zone; the other being that, as shown in II of FIG. 6, that level varies within the range of from the equilibrium potential Veq to 0 V or a potential higher than this voltage level of 0 V, wherein the auxiliary electrode 16 is maintained at a voltage of 0 V.

Where the cathode potential is varied within the range II all the photoelectrons released from the cathode 14 pass, in principle, through the auxiliary electrode 16 to reach the output electrode 18. In contrast, where the cathode potential is varied within the range I, during the period in which the cathode potential has a negative value lower than that of the potential of the auxiliary electrode 16 the photoelectrons released from the cathode 14 are partially absorbed into the auxiliary electrode 16 and the remaining photoelectrons reach the output electrode 18. In this case, there is a likelihood that the utilization efficiency of the photoelectrons is decreased and that secondary electrons are undesirably emitted from the auxiliary electrode 16. In any case where the cathode electrode is varied within the range I or II, the whole or part of the photoelectrons produced from the cathode are accelerated toward the output electrode 18 to impinge upon the same, with the result that the light corresponding to the input signal is emitted from this output electrode 18.

Figure 7:
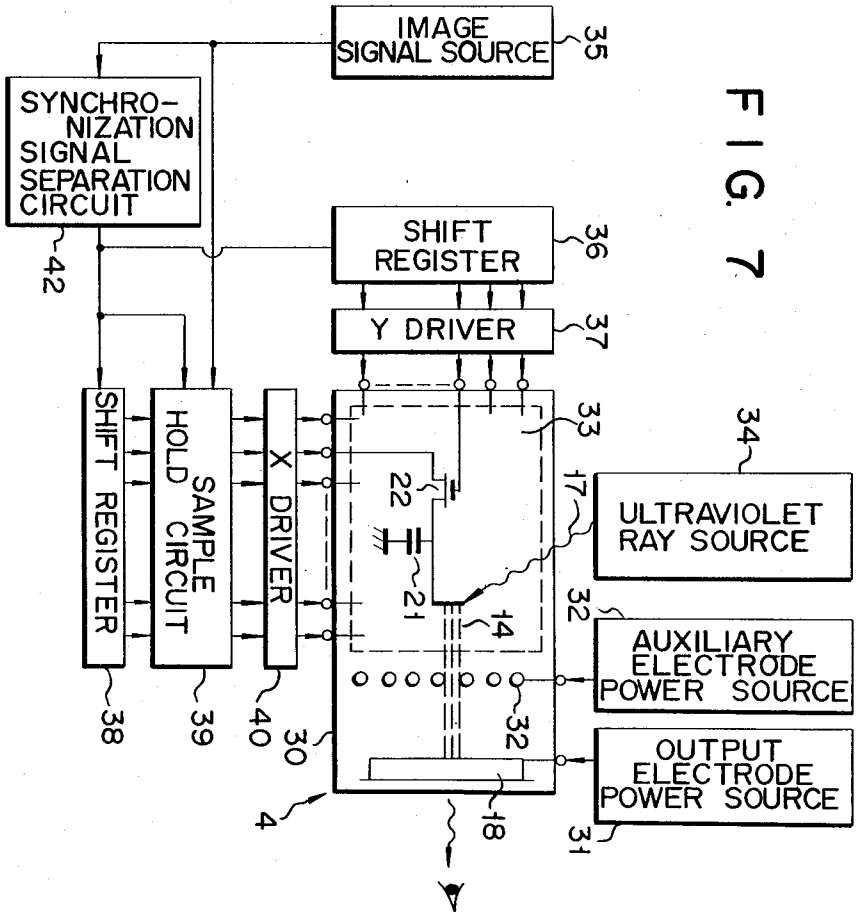
FIG. 7 shows a circuit for driving the display device shown in FIGS. 3A and 3B.

Next, a driving circuit for the embodiment of the invention will now be described in connection with FIG. 7. To the output electrode 18 and the auxiliary electrode 16, there are connected an output electrode power source 31 and an auxiliary electrode power source 32 which are designed to apply specified voltages to the electrodes 18 and 16, respectively. Further, the display device 30 has a cathode matrix 33 wherein the picture elements each of which comprised of the FET 22, capacitor 21 and photoelectric cathode 14 are arranged in the matrix form. The photoelectric cathode 14 of this cathode matrix 33 is irradiated with the ultraviolet rays 17 from an ultraviolet ray source 34.

This cathode matrix 33 is operated by what is called "one-line-at-a-time-input-system" in which an image signal is applied to the picture element at a time during the period of time ΔT. That is, a synchronization signal is separated, by a synchronization signal separation circuit 42, from an image signal supplied thereto from an image-signal source 35. A shift register 36 is operated by the synchronization signal and a Y driver 37 is operated by the shift register 36 so that pulses are supplied to the gates of the FET's 22 corresponding to the one-column picture elements from the Y driver 37 during the period ΔT. Further, the image signal corresponding to the one-column picture elements is supplied to a sample holde circuit 39 operated by a shift register 38 and the image signal varying on a time basis is converted into picture element signals for each row, an X driver 40 is operated by the picture element signals and the capacitors 21 of the one-column picture elements are charged by the X driver 40 at one time within the period of time ΔT, whereby the picture elements emit lights. When this operation is sequentially carried out for each column, the input signal is applied over the whole area of the two-dimensional screen, whereby a planar image is displayed.

In the above-mentioned planar display device, the picture screen of the device can be subjected, over the whole area thereof, to the light emission with a uniform luminance. Namely, since the amount of lights emitted from the fluorescent screen is determined correspondingly to the amount of electrons impinging thereupon, and in the planar display device of the invention the electric charge charged into the picture element capacitor is released, the luminance of the picture element is determined correspondingly to the input signal. Furthermore, even when the illuminance of the ultraviolet rays is not uniform, even when the cathode has not uniform quantum efficiency at the positions on the surface thereof, or even when the auxiliary electrode is not fabricated with high precision or the cathode is misaligned with the auxiliary electrode with the result that the equilibrium potential slightly differs for each cathode, the invention enables the picture element to emit light in correspondence to the amount charged. Further, even when the variations occur in the capacitance of the picture element capacitor, the invention can prevent those variations from affecting the brightness of the picture element. Further, while, in a prior art method of controlling the power supplied to each picture element with the grid of the FET, the variations in characteristic of the FETs have a direct undesirable effect upon the brightness of the picture element, the display device of the invention has a merit that this problem is lessened since, in this display device, the FET has only to operate on a digital on-off basis. According to this invention, the potential of a cathode can be advantageously adjusted within an operation voltage range of a driver circuit by applying a negative potential from an auxiliary electrode power source to the auxiliary electrode. Furthermore, an equilibrium potential Veg can also be adjusted. It is therefore possible to properly adjust the input impedance of the cathode.

In the planar display device, even after the write-in of signal has been effected for a short period of time, it is possible to keep the fluorescent layer still in a state wherein it emits lights until the charge accumulated has been discharged. The display device of the invention, therefore, enables lessening such a flicker as would occur in the prior art point-sequential or line-sequential system, whereby to obtain a stable picture image with the result that the luminance thereof can be increased. Further, since the device according to the invention can be made planar in structure, it can offer a practical convenience.

To add in regard to the lessened flicker of the invention, the following can be said. That is, while the application of the invention to a display device of a commercial television makes it possible to obtain a picture image having a brightness and a lessened flicker, where the device of the invention is used in a low-speed scanning system or a system of lessened per-second image number such as a television phone system it is possible to elongate the light emission time of the fluorescent screen and obtain a bright picture image free from flickers by affording suitable designing conditions to the size of the picture element, the largeness of the write-in signal, etc.

It should be noted here that although the device of the invention is arranged, as mentioned before, such that the cathode is designed in principle to have its potential returned to its equilibrium potential by the time when the next write-in period of time comes, the device can be also operated, in some cases, such that the device waits for the next write-in period of time in a state wherein there exists more or less residual charge in the capacitor. In this case, however, it is preferable newly to write in the amount Qsig charged corresponding to the input signal regardless of the existence of the residual charge by contriving the method of writing-in.

An impedance may be also inserted in series between the capacitor and the cathode and, by selecting the impedance suitably, control is made of the condition of discharging the signal charge relative to time lapse, thereby obtaining desired characteristics in regard to the flicker, luminance, etc. Use may be made, as this impedance, of a fixed value impedance, a non-linear element depending upon the current passing therethrough or the voltage of the circuit involved, or a switching element which, within a certain period of time (for example, within a write-in period of time), has an infinite impedance, that is, is brought into a state wherein the current is cut off.

In the above-mentioned embodiment, the cathode is the photoelectric type. However, the cathode may be a thermionic emission type, a secondary electron emission type, an electric field production type or a radioisotope type. In the radioistope cathode capable of generating $\alpha$ rays or $\beta$ rays, the electrons are released directly or indirectly from the cathode by exciting the cathode.

Figure 8A:
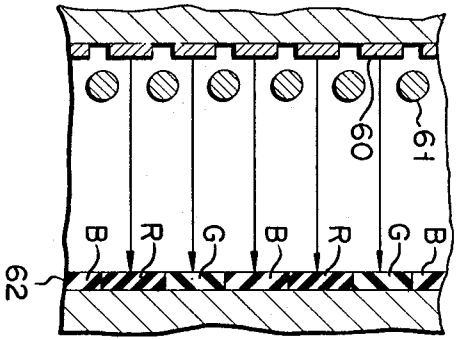
FIGS. 8A and 8B are partially sectional views showing modifications of the output electrode, respectively.
Figure 8B:
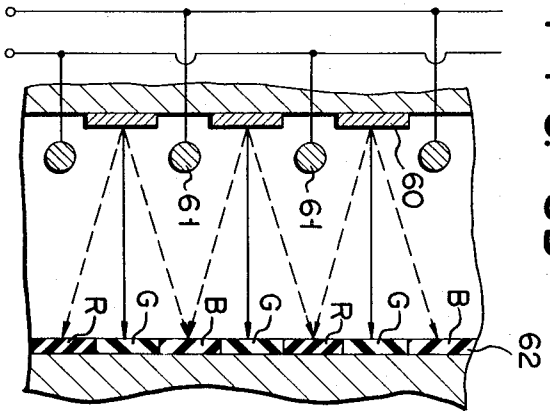

Further, description has above been made of an example wherein the fluorescent material layer of the output electrode was constituted by a monochromatic fluorescent material. However, as shown in FIG. 8A, color display can be made by disposing, correspondingly to the picture element cathode 60, a multicolored fluorescent layers of dot or line type, such as a fluorescent layers for three-color display of red (R), green (G) and blue (B). Further, as shown in FIG. 8B, a red (R), green (G) and blue (B) fluorescent layers are coated in the linear form; the auxiliary electrodes are provided in parallel with the lines of the red, green and blue fluorescent layers and are subjected, on every second basis, to wire connection; and a potential difference is afforded therebetween so as to deflect the potential distribution and thereby to deflect the electron beams released from the picture element cathode 60, thus to excite the desired fluorecent layers line to subject the same to the light emission. In this embodiment shown in FIG. 8B, there is no need to provide the cathodes 60 correspondingly to the number of the fluorescent layers, with the result that it is possible to reduce the cathode in number.

For the output electrode, use may of course be made of a material which is capable of emitting light directly or indirectly, or indicating a variation in the optical propery, upon recipt of the cathode rays, as well as the fluorescent material capable of being excited by the cathode rays.

Figure 9A:
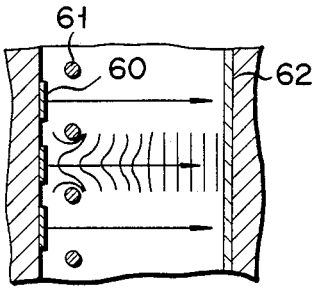
FIGS. 9A to 9G are partially sectional views showing various modifications of the auxiliary electrode, respectively.
Figure 9B:
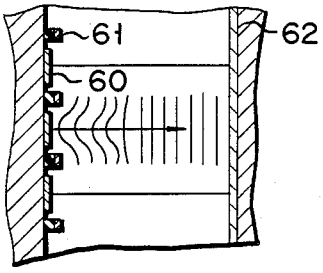

The auxiliary electrode 61 is formed of a rigid metal plate and may be also prepared by tensioning a mesh-like member to a frame as shown in FIGS. 9A and 9B. Further, the auxiliary electrode 61 may be also prepared by being provided on a substrate mounted with the cathode in such a manner that it is insulated therefrom. Further, as in the embodiment shown in FIG. 9B, arrangement may be also made such that either the cathode substrate or the auxiliary electrode has a rigidity to obtain a structure wherein one of the two having rigidity has the other adhered or pressed thereto. This structure offers a convenience in finally assembling the cathode, auxiliary electrode, etc. with an anode. It should be noted here that, at this time, an insulative material (for example, glass) may be inserted as a spacer between both. This is an effective method for obtaining a firm assembly.

Figure 9C:
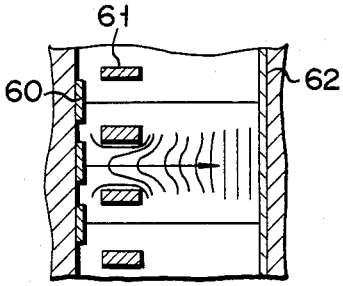
Figure 9D:
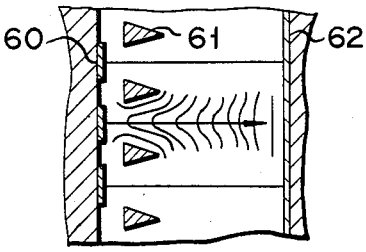
Figure 9E:
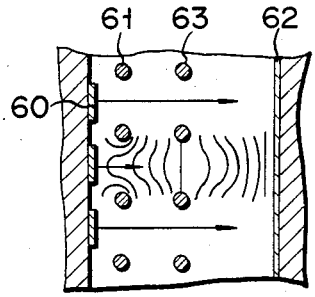

In the display device of the invention, it is preferable that the electrons are not so widely spread, after the electron beams have passed through the auxiliary electrode, until those electron beams reach the output electrode. To this end, it is preferable to form a potential distribution causing the electron beams to be focussed. As shown in FIGS. 9C to 9E, a structure is preferably adopted in which the auxiliary electrode is formed thick, or a structure is preferably adopted in which the auxiliary electrode has a triangular cross-section, or a structure is preferably adopted in which one or more additional auxiliary electrodes are provided separately from the auxiliary electrode 61.

Figure 9F:
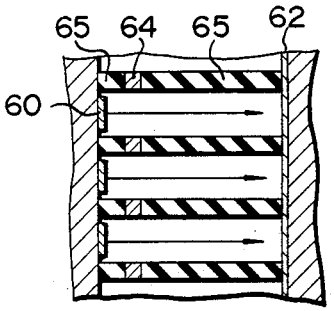
Figure 9G:
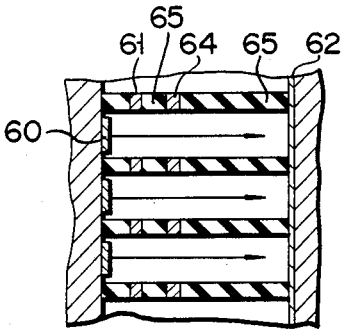

As the other structures, it is possible to alternately pile up an insulator 65 and a conductor 64 for use in the electrode between the cathode and the fluorescent screen and provide bore-like passages for each picture element, as shown in FIG. 9F. Further, a structure shown in FIG. 9C based on the combination of the two structures shown in FIGS. 9E and 9F may be also adopted. In this structure, however, there is a likelihood that the inner surface of the bore-like passages is charged whereby the opertion is disturbed. In such a case, countermeasures are preferably taken to make the insulator per se or the surface thereof slightly conductive, thereby to prevent the occurrence of an unstable surface charging. Further, if a secondary electron release material is provided on the side surface of said insulator to multiply the electron flow, it is possible to enhance the luminance of the resultant picture element.

Figure 10:
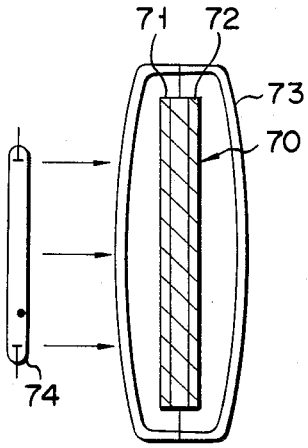
FIG. 10 is a sectional view schematically showing the display device according to another embodiment of the invention.

In the embodiment shown in FIG. 3, the output electrode and the cathode were provided on the inner surfaces of the front plate and rear plate of the vacuumized envelope. However, it is also possible to receive one or both of them into a separate envelope from such vacuumized envelope as shown in FIG. 10. In this embodiment, a main body 70 of the device comprised of the cathode 71 and the output electrode 72 is wholly sealed into a separate envelope 73, and a mercury lamp 74 constituting the ultraviolet rays source is disposed outside said separate vacuum envelope 73. Since, therefore, said main body is not affected at all by the atmospheric pressure, the front plate formed thereon with the output electrode and the rear plate formed thereon with the cathode may each be a thin planar plate.

When it is desired to form a display panel of large area, it is possible to prepare a large number of display units having a suitable size and join them in the form of tile or mosaic arrangement, thereby constructing the whole display panel. This method makes it possible to decrease the yield of defective products as compared with the method to form an integral display panel of large area.

The method of exciting the photoelectric cathode is to irradiate the cathode with the external light capable of giving forth visible lights or ultraviolet rays as shown in FIGS. 3 or 4. Generally, a mercury lamp is used as the light source for ultraviolet rays.

Figure 11A:
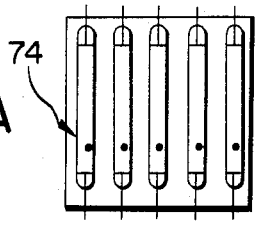
FIGS. 11A to 11C are plan views showing various examples of a light source.
Figure 11B:
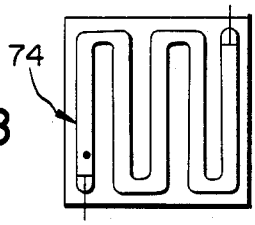
Figure 11C:
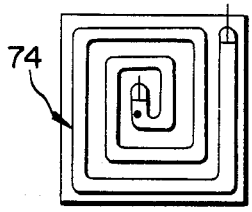
Figure 12:
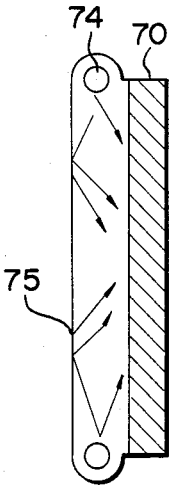
FIGS. 12 to 14 are sectional views showing modifications of the display device according to the invention, respectively.

In order to illuminate as uniformly as possible, there are the following three cases: one is to use a plurality of lamps as shown in FIG. 11A, a second one is to use a zigzag lamp as shown in FIG. 11B, and a third and final one is to use a helical lamp as shown in FIG. 11C. Additionally, it is also possible to receive one or more lamps 74 within a case 75 as shown in FIG. 12 and illuminate the photoelectric cathode from the back thereof by reflection or diffusion within the case 75. In this case, the inner surface of the case is formed into a mirror surface or diffusion surface for the purpose of obtaining the uniformity with which the cathode is irradiated with light.

Figure 13:
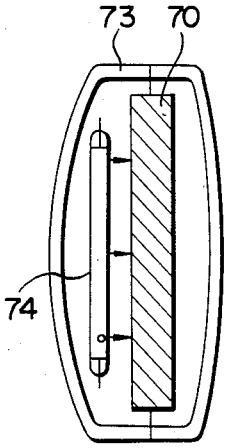
Figure 14:
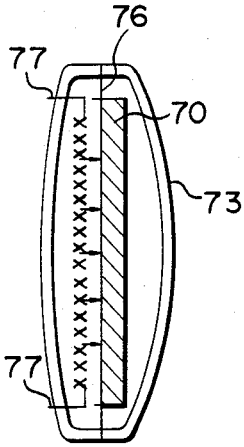

In the case of the ultraviolet rays source, a shield is preferably provided in such a manner as to prevent the ultraviolet rays from being released from the picture screen, for the purpose of preventing the ultraviolet rays from entering the human eyes to damage them. Further, it is necessary to suppress the possible effect of ozone production upon a human body, and to this end it is preferable to make the mercury lamp airtight and further to cover the same with a nitrogen atmosphere, for example, so as to remove oxygen from the surrounding. In the embodiment of FIG. 13 wherein the mercury lamp is sealed into a vacuum envelope, it is possible to remove the effect of ultraviolet rays upon a human body. Furthermore, it is also possible to isolate, as shown in FIG. 14, a rear section of the vacuum envelope by means of an isolation plate 76 and fill a discharge gas thereinto, thereby to irradiate the cathode with the ultraviolet rays given forth when discharge is allowed to occur between discharge electrodes 77.

Figure 15:
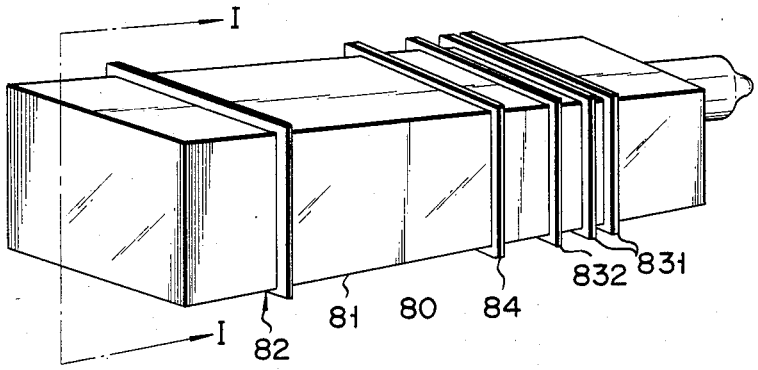
FIG. 15 is a perspective view showing a display unit of the display device according to still another embodiment of the invention.
Figure 16:
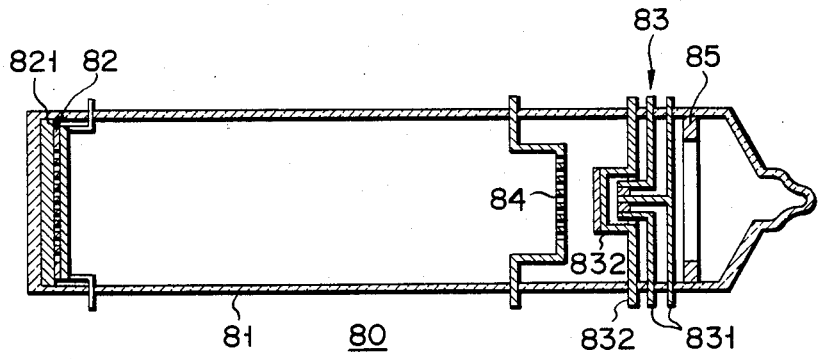
FIG. 16 is a sectional view taken along the line I—I of FIG. 15.

In the above-mentioned embodiments, a plurality of cathodes are disposed within one vacuum envelope. According to the present invention, however, it is also possible to provide a single cathode within one envelope as shown in FIGS. 15 and 16, thereby to form a unitary display unit 80, and combine a plurality of such units into one display device. That is, in the display unit 80 shown in FIGS. 15 and 16, a fluorescent section 82 is formed on one inside surface of the envelope 81 formed of soft glass and having its interior evacuated, while, on the other hand, a cathode section 83 is provided in a space close to the other inside surface opposed to said one inside surface. Between the fluorescent section 82 and the cathode section 83, an auxiliary electrode or grid 84 is disposed for the purpose of applying a specified equilibrium potential to the cathode section 83. Further, within the envelope 81, a getter 85 is provided so as not to obstruct the movement of the electrons released from the cathode section 83.

The fluorescent section 82 is comprised of a fluorescent layer 821 formed on said one inside surface, a fluorescent surface electrode 822 formed on this layer 821, and an aluminum backed layer 823.

The fluorescent electrode 822 is made of an iron-nickel alloy and sealed in the envelope 81 formed of soft glass. Further, this electrode 822 is rectangular and has its flanged portion sealed to the envelope 81 and its mesh-like portion allowed to abut against the fluorescent layer 821. Further, where the fluorescent layer 821 is formed using a slurry prepared by mixing fluorescent particles and binder, the mesh-like portion of the fluorescent electrode 822 is not required to be provided since the fluorescent layer 821 is adhered to the inner surface of the envelope 81.

The cathode 83 is comprised of a heater 831 and a cathode 832 having a thermionic current release layer on its top surface. These electrodes 831 and 832 are sealed in the envelope 81, respectively.

In this display device 80, a capacitor (not shown) for accumulating a signal charge therein is connected to the cathode electrode 832.

The operation of this display device 80 is the same as in the case of the above-mentioned operation, and a description thereof is omitted.

Since, in this display device 80, one picture element is constituted by one envelope, it is possible to make the envelope thin as compared with a case where the whole display device is received within an envelope. Further, in this display device 80, the respective electrodes are lead out from the side of the envelope, whereby common connection can be easily made in piling up these display devices.

As already partially stated, the present invention can be applied to various television displays of a black-and-white television or color television, and besides the invention may be also applied to various displays such as, for example, various display terminals of a computer, radar display, etc.

In the display device according to the invention, the picture elements can be arranged in the form of a matrix having a plane of X-Y as already mentioned but, in addition, the picture elements may be also arranged or disposed in the form of a letter "8".

The above description has been made of the light emitting display device using the electron current. However, the invention is also applicable to a display device which uses a light emitting diode or passive liquid crystal display device as the display portion.

As stated above, according to the invention, there is obtained a display device which is low in the power consumption, high in the luminance and less in the flicker, and which makes it easy to obtain a picture image uniformity over the whole surface of the display section and which can follow up with the speedy change in brightness.

What is claimed is:

1. A display device comprising:

means for converting a plurality of input signals into corresponding signal electric charges, each signal corresponding to a picture element to be displayed;

an airtight envelope;

means, including a plurality of storage elements, connected with said converting means, for receiving each of the signal electric charges and storing it in a corresponding storage element;

cathode means including a plurality of cathode elements disposed within said envelope and electrically connected to respective storage elements for discharging the signal electric charges from their corresponding storage elements and emitting electrons corresponding thereto; and a plurality of elements, disposed in said envelope, each being responsive to electrons emitted by a corresponding cathode element impinging thereon, for emitting light having an intensity corresponding to its respective input signal.

2. A display device according to claim 1, further comprising a first auxiliary electrode disposed in a path of electrons flowing from said cathode means and maintained at a predetermined potential.

3. A display device according to claim 2, further comprising a second auxiliary electrode arranged in the path of electrons between said first auxiliary electrode and said light emitting elements and maintained at a predetermined potential.

4. A display device according to claim 1, wherein said cathode means comprises a photoelectric cathode capable of being excited by being irradiated with a light.

5. A display device according to claim 4, further comprising a light source for irradiating lights onto said photoelectric cathode.

6. A display device according to claim 5, wherein said light source includes means for emitting ultraviolet rays; and wherein said photoelectric cathode is excited by the ultraviolet rays.

7. A display device according to claim 2, wherein said first auxiliary electrode a coating formed on an insulation layer formed on said cathode means.

8. A display device according to claim 2, further comprising:

a first insulation member provided between said first auxiliary electrode and said cathode means; and a second insulation member provided between said first auxiliary electrode and said light emitting elements, said first auxiliary electrode being supported by both said insulation members.

9. A display device according to claim 3 further comprising:

a first insulation member provided between said first auxiliary electrode and said cathode means;

a second insulation member provided between said second auxiliary electrode and said light emitting means; and a third insulation member is provided between said first and second auxiliary electrodes, said auxiliary electrodes being supported by said insulation members.

10. A display device according to claim 1, wherein said cathode elements are arranged in the form of a matrix.

11. A display device according to claim 1, wherein said light emitting elements emit light of different wavelengths.

12. A display device according to claim 1, further comprising:

switch means, connected between said converting means and said storing means, said switch means providing a closed electrical circuit for a predetermined period of time.

13. A display device according to claim 1, wherein said storage elements and said cathode means are formed on a surface within said envelope.

* * * * *